US009689088B2

(12) United States Patent
Goodwin et al.

(10) Patent No.: US 9,689,088 B2
(45) Date of Patent: Jun. 27, 2017

(54) WOOLSCOURING METHOD AND COMPOSITION

(71) Applicant: CRODA INTERNATIONAL PLC, Yorkshire (GB)

(72) Inventors: Mahzad Goodwin, Yorkshire (GB); Peter Michael Murphy, Yorkshire (GB); Simon Paul Flavin, Yorkshire (GB)

(73) Assignee: Croda International PLC, East Yorkshire (GB)

( * ) Notice: Subject to any disclaimer, the term of this patent is extended or adjusted under 35 U.S.C. 154(b) by 47 days.

(21) Appl. No.: 14/652,357

(22) PCT Filed: Dec. 10, 2013

(86) PCT No.: PCT/GB2013/053247

§ 371 (c)(1),
(2) Date: Jun. 15, 2015

(87) PCT Pub. No.: WO2014/096776

PCT Pub. Date: Jun. 26, 2014

(65) Prior Publication Data

US 2015/0329990 A1 Nov. 19, 2015

(30) Foreign Application Priority Data

Dec. 18, 2012 (GB) ..... 1222820.1

(51) Int. Cl.
*C11D 1/72* (2006.01)
*C11D 1/722* (2006.01)
(Continued)

(52) U.S. Cl.
CPC ..... *D01C 3/00* (2013.01); *C11B 1/10* (2013.01); *C11B 11/005* (2013.01);
(Continued)

(58) Field of Classification Search
CPC ..... C11D 1/72; C11D 1/722; C11D 1/825; C11D 1/8255; D01C 3/00
See application file for complete search history.

(56) References Cited

U.S. PATENT DOCUMENTS 4,129,514 A 12/1978 Caffarel
4,201,686 A 5/1980 Augustijn
(Continued)

FOREIGN PATENT DOCUMENTS

GB 716641 * 10/1954 ..... C11D 1/8255
WO 9524219 9/1995
WO 2011094942 8/2011

OTHER PUBLICATIONS

International Preliminary Report on Patentability for International Application No. PCT/GB2013/053247 mailed Jun. 23, 2015.
(Continued)

*Primary Examiner* — Brian P Mruk
(74) *Attorney, Agent, or Firm* — RatnerPrestia

(57) ABSTRACT

The present invention relates to a method of washing animal fibers comprising contacting the animal fibers with a surfactant composition comprising a mixture of alcohol ethoxylate surfactants and optionally at least one propoxylated surfactant.

16 Claims, 1 Drawing Sheet

(51) Int. Cl.

| | |
|---|---|
| ***C11D 1/825*** | (2006.01) |
| ***D01C 3/00*** | (2006.01) |
| ***C11B 1/10*** | (2006.01) |
| ***C11B 11/00*** | (2006.01) |

(52) U.S. Cl.
CPC ..... *C11D 1/8255* (2013.01); *C11D 1/72* (2013.01); *C11D 1/722* (2013.01)

(56) References Cited

U.S. PATENT DOCUMENTS

| | | | | |
|---|---|---|---|---|
| 4,426,298 | A * | 1/1984 | Shepley | D06M 7/00 252/8.81 |
| 5,364,552 | A * | 11/1994 | Merz | C11D 1/8255 510/340 |
| 6,518,232 | B1 | 2/2003 | Mertens | |
| 2002/0165115 | A1* | 11/2002 | Daniels | C07C 43/11 510/421 |
| 2005/0170991 | A1 | 8/2005 | Ruland | |

OTHER PUBLICATIONS

International Search Report for International Application No. PCT/GB2013/053247 mailed Feb. 28, 2014.

* cited by examiner

WOOLSCOURING METHOD AND COMPOSITION

CROSS REFERENCE TO RELATED APPLICATIONS

This application is the U.S. National Phase application of PCT International Application No. PCT/GB2013/053247, filed Dec. 10, 2013, and claims priority of GB 1222820.1, filed Dec. 18, 2012, the disclosures of which are incorporated herein by reference in their entireties for all purposes.

FIELD OF INVENTION

The present invention relates to a method for cleaning animal fibers, in particular to the degreasing of wool, using a surfactant composition, and to the surfactant composition for the cleaning of animal fibers.

BACKGROUND

Raw wool contains three main contaminants: dirt, water soluble contamination (wool suint) and wool grease, which together account for about 20-30% of the fleece weight. Typically, the wool grease content of the raw fleece may be around 3 to 6%.

Wool scouring is performed to convert dirty greasy wool into clean scoured wool. The first step of raw wool scouring is to remove the impurities present in the wool by suitable physical or chemical means. Conventionally, the process of cleaning/scouring of animal fibers, for example woolscouring, involves the submersion of greasy fibers in a series of aqueous bowls. The initial bowls, heated to temperatures of 50-70° C. contain a surfactant composition to remove the greasy residues of the animal fibers, for example wool. The method involves a further number of wash bowls to remove any surfactant residue or dirt residue remaining on the animal fibers, for example wool. The wash bowls may be either hot or cold and may also include further chemicals such as for example hydrogen peroxide or organic acids to further improve the quality of the animal fibers, for example wool being scoured. These chemicals are not however designed to remove or affect the grease which is removed in the initial bowls. Once the raw wool has been processed through the bowls containing surfactant solution, the remaining spent surfactant solution contains emulsified wool grease.

Wool grease is a complex mixture containing mostly of esters of long chain fatty acids with long chain alcohols and sterols. Wool grease can be processed into lanolin, wool wax alcohols (lanolin alcohol), wool wax acids (lanolin acids), lanolin derivatives and wool wax alcohol derivatives. Lanolin is a multi-functional commercially highly valuable product and is used for example in the production of soap and cosmetics. Mixed wool-wax alcohols can be formed by hydrolysis of the esters followed by solvent extraction of the alcohols. Mixed wool-wax alcohols are used for example in medicinal products and toiletries. It is therefore desirable to remove the wool grease from the emulsion-scouring liquor as effectively as possible. Wool grease also includes cholesterol which is used for example in cosmetic products and industrial products.

One conventional method for removing wool grease from the emulsion-scouring liquor is the centrifugal method. The centrifugal method involves passing the emulsion-scouring liquor through a desludging centrifuge. The desludging centrifuge provides a wool-grease concentrate stream which is rich in lanolin. A second conventional method is the acid-cracking method.

Conventionally, nonylphenol ethoxylates have been used as the surfactant in the wool scouring process to remove natural greases from wool. There is however, concern that nonylphenol ethoxylates may break down and release nonylphenol into the environment. Nonylphenol is difficult to break down and it bio-accumulates in the environment. Nonylphenol has been found to be highly toxic to aquatic organisms and can cause long term adverse effects in the aquatic environment. Furthermore, it is undesirable for nonylphenol to be present within the products produced from refined woolgrease.

The use of a primary alcohol ethoxylate has also been disclosed for wool scouring. It has however been found that the use of a primary alcohol ethoxylate results in reduced efficiency in terms of wool grease removal from wool.

Furthermore, the use of conventional surfactants has been found to provide grease residues which are difficult to separate using the centrifugal method due to the stability of the emulsions.

There is therefore a need for a method of cleaning animal fibers, for example wool, which uses a more environmentally friendly surfactant. There is also a need for a method or a surfactant with improved efficiency for grease removal from animal fibers, for example wool. There is also a need for a method or surfactant which provides a grease residue from the animal fibers, in which the grease residue has reduced stability and as a result provides easier separation of the grease, for example requiring a lower splitting speed during the centrifugal method.

SUMMARY OF THE INVENTION

The applicant has now advantageously discovered a method, and a surfactant composition, for cleaning animal fibers which seeks to address at least one of the aforementioned problems associated with conventional methods/surfactants for cleaning animal fibers, for example for degreasing wool.

Embodiments of the present invention provide a method and a surfactant composition for cleaning animal fibers with improved efficiency. The surfactant composition has been surprisingly found to have improved efficiency for removing dirt, for example grease, from a variety of animal fibers, for example from wool. Embodiments of the present invention also provide an environmentally friendly, readily biodegradable surfactant composition which is a good alternative to conventional cleaning compositions (such as for example nonylphenol ethoxylate) for animal fibers, for example wool.

According to a first aspect of the invention, there is provided a method of cleaning animal fibers comprising contacting the animal fibers with a surfactant composition comprising a mixture of alcohol ethoxylate surfactants. In particular, the method of the present invention is preferably used for cleaning wool, for example for degreasing wool.

DETAILED DESCRIPTION

Figure 1:
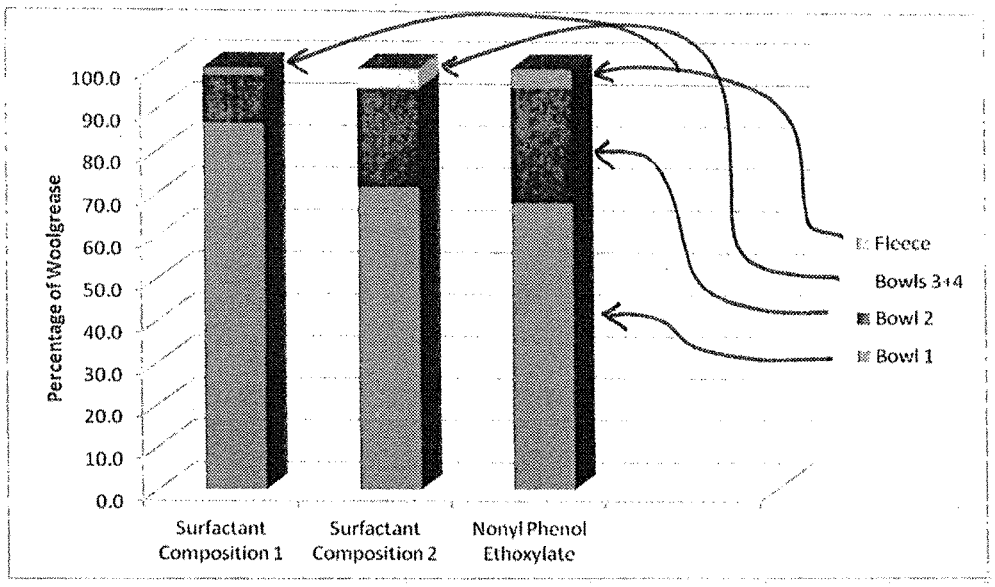
FIG. 1 shows the weights of woolgrease obtained for three different surfactants.

The mixture of alcohol ethoxylate surfactants preferably comprises, consists essentially of, or consists of 2 surfactants having a different degree of ethoxylation that vary in the range of from 2 to 8; more preferably in the range of from 3 to 6; particularly in the range of from 4 to 5; and especially in the range of from 4.3 to 4.7 ethylene oxide (EO) groups. The hydrophobe component of the 2 surfactants, i.e. the fatty, preferably alkyl, chain, may be the same or different.

The method preferably comprises contacting the animal fibers with a surfactant composition comprising a blend of alcohol ethoxylates represented by the following formulae:

$$R^1(OCH_2CH_2)_{n1}—OH \text{ and } R^2(OCH_2CH_2)_{n2}—OH$$

in which:

- $R^1$ and $R^2$ are, independently, linear alkyl groups having an average carbon chain length in the range of from $C_5$ to $C_{20}$; particularly in the range of from $C_6$ to $C_{18}$, and especially in the range of from $C_7$ to $C_{15}$; for example $C_8$ or $C_{13}$ to $C_{14}$;
- $n_1$ is preferably in the range of from 0.5 to 4; more preferably in the range of from 1 to 3; particularly in the range of from 1.5 to 2.5; especially in the range of from 1.8 to 2.2, for example 2;
- $n_2$ is preferably in the range of from 3.5 to 10; more preferably in the range of from 5 to 8; particularly in the range of from 6 to 7; especially in the range of from 6.3 to 6.7, for example 6.5; and
- $(n_2-n_1)$ is preferably in the range of from 2 to 8; more preferably in the range of from 3 to 6; particularly in the range of from 4 to 5; especially in the range of from 4.3 to 4.7, for example 4.5

$n_1$ and $n_2$ are average values (i.e. can be non-integer).

The ratio by weight of the first alcohol ethoxylate having the formula $R^1(OCH_2CH_2)_{n1}$—OH to the second alcohol ethoxylate having the formula $R^2(OCH_2CH_2)_{n2}$—OH in the surfactant composition is preferably 1:0.5 to 20; more preferably 1:3 to 15; and particularly 1:5 to 11.

In one embodiment, $R^1$ and $R^2$ are, independently, linear alkyl groups having an average carbon chain length in the range of from $C_5$ to $C_{12}$; particularly in the range of from $C_6$ to $C_{10}$, and especially in the range of from $C_7$ to $C_9$; for example $C_8$. In this embodiment $R^1$ and $R^2$ are preferably the same. The ratio by weight of the first alcohol ethoxylate having the formula $R^1(OCH_2CH_2)_{n1}$—OH to the second alcohol ethoxylate having the formula $R^2(OCH_2CH_2)_{n2}$—OH in the surfactant composition of this embodiment is preferably 1:0.5 to 20; more preferably 1:3 to 10; and particularly 1:5.5 to 6.5.

In another embodiment, $R^1$ and $R^2$ are preferably not the same. In this embodiment, (i) one of $R^1$ or $R^2$, preferably $R^2$, is a linear alkyl group having an average carbon chain length in the range of from $C_5$ to $C_{12}$; particularly in the range of from $C_6$ to $C_{10}$, and especially in the range of from $C_7$ to $C_9$; for example $C_8$; and (ii) the other of $R^1$ or $R^2$, preferably $R^1$, is a linear alkyl group having an average carbon chain length in the range of from $C_9$ to $C_{20}$; particularly in the range of from $C_{10}$ to $C_{18}$, and especially in the range of from $C_{12}$ to $C_{15}$; for example $C_{13}$ to $C_{14}$. In this embodiment, the difference in the average carbon chain length of $R^1$ and $R^2$ ($R^1>R^2$) is preferably in the range of from 3 to 9, particularly in the range of from 4 to 8, and especially in the range of from 5 to 6 carbon atoms. The ratio by weight of the first alcohol ethoxylate having the formula $R^1(OCH_2CH_2)_{n1}$—OH to the second alcohol ethoxylate having the formula $R^2(OCH_2CH_2)_{n2}$—OH in the surfactant composition of this embodiment is preferably 1:3 to 25; more preferably 1:7 to 15; and particularly 1:9.5 to 10.5.

The surfactant composition used in the present invention suitably comprises the mixture of the alcohol ethoxylate surfactants in a concentration of from 86% to 100% by weight; preferably in a concentration of from 90% to 100% by weight; more preferably in a concentration of from 92% to 98% by weight; particularly in a concentration from 94% to 97%; and especially in a concentration from 94% to 96% by weight, based on the total weight of surfactants.

The surfactant composition may further comprise at least one (or a first) propoxylated surfactant, preferably an alcohol propoxylate. In addition to propylene oxide (PO) groups, the at least one (or first) propoxylated surfactant preferably also contains ethylene oxide (EO) groups, i.e. is a propoxylated/ethoxylated surfactant. The propoxylated surfactant preferably comprises a greater number of (EO) groups than (PO) groups.

The (first) propoxylated surfactant is suitably represented by the following formula:

$$R^3—Y-[(PO)_{m1}/(EO)_{p1}]-H$$

in which:

- $R^3$ is a hydrocarbon group, for example a linear alkyl group, having an average chain length in the range of from $C_6$ to $C_{16}$, preferably in the range of from $C_8$ to $C_{12}$, particularly in the range of from $C_9$ to $C_{11}$. The propoxylated surfactant may comprise a blend of surfactants in which about 20% (more particularly 18%) of the $R^3$ group is composed of $C_9$ alkyl groups, about 50% of the $R^3$ group is composed of $C_{10}$ alkyl groups, and about 30% (more particularly 32%) of the $R^3$ group is composed of $C_{11}$ alkyl groups;

PO represents $C_3H_6O$, and EO represents $C_2H_4O$;

- $m_1$ is preferably in the range of from 0.5 to 6; more preferably 1 to 4; particularly in the range of from 2 to 3; especially in the range of from 2.2 to 2.6; for example 2.4;
- $p_1$ is preferably in the range of from 0 to 9; more preferably in the range of from 2 to 7; particularly in the range of from 3.5 to 5.5; especially in the range of from 5.0 to 5.2; for example 5.1;
- $(m_1+p_1)$ is preferably in the range of from 2 to 12; more preferably in the range of from 5 to 10; particularly in the range of from 6 to 9; especially in the range of from 7 to 8; for example 7.5; and
- Y is —O—, —COO—, —CONH— or —NHCO—, preferably —O—.

$m_1$ and $p_1$ are average values (i.e. can be non-integer).

Preferably $(p_1-m_1)$ is in the range of from 0.5 to 6; more preferably in the range of from 1 to 4; particularly in the range of from 2 to 3; especially in the range of from 2.5 to 2.9, for example 2.7.

The (PO) groups and (EO) groups may be present in random or block form, and the order in which (PO) and (EO) groups are added is not limited. Preferably the (EO) group is attached to the hydrophobe, i.e. attached to $R^3$—Y— group and the (PO) group is an endcap.

The surfactant composition used in the present invention suitably comprises the (first) propoxylated surfactant in a concentration of from 0% to 8% by weight; preferably in a concentration of from 0.1% to 8% by weight; more preferably in a concentration of from 0.5% to 6% by weight; particularly in a concentration of from 1% to 4% by weight; especially in a concentration of 2% to 4% by weight, based on the total weight of surfactants.

In a second aspect, the present invention provides a surfactant composition for cleaning animal fibers, for example for degreasing wool, in which the composition comprises a mixture of alcohol ethoxylate surfactants and at least one propoxylated surfactant. The mixture of alcohol ethoxylates may be referred to as an alcohol ethoxylate blend.

The blend of alcohol ethoxylate surfactants of the surfactant composition of the present invention preferably comprises a blend of ethoxylates of linear fatty alcohol. The ethoxylated surfactants are preferably short chain ethoxylates of linear fatty alcohol.

The surfactant composition preferably comprises a blend of alcohol ethoxylates represented by the following formulae:

$$R^1(OCH_2CH_2)_{n1}—OH \text{ and } R^2(OCH_2CH_2)_{n2}—OH$$

in which:

- $R^1$ and $R^2$ are, independently, linear alkyl groups having an average carbon chain length in the range of from $C_5$ to $C_{20}$; particularly in the range of from $C_6$ to $C_{18}$, and especially in the range of from $C_7$ to $C_{15}$; for example $C_8$ or $C_{13}$ to $C_{14}$;
- $n_1$ is preferably in the range of from 0.5 to 4; more preferably in the range of from 1 to 3; particularly in the range of from 1.5 to 2.5; especially in the range of from 1.8 to 2.2, for example 2;
- $n_2$ is preferably in the range of from 3.5 to 10; more preferably in the range of from 5 to 8; particularly in the range of from 6 to 7; especially in the range of from 6.3 to 6.7, for example 6.5; and
- $(n_2-n_1)$ is preferably in the range of from 2 to 8; more preferably in the range of from 3 to 6; particularly in the range of from 4 to 5; especially in the range of from 4.3 to 4.7, for example 4.5; and at least one propoxylated surfactant represented by the following formula:

$$R^3—Y-[(PO)_{m1}/(EO)_{p1}]-H$$

in which:

- $R^3$ is a hydrocarbon group, for example a linear alkyl group, having an average chain length in the range of from $C_6$ to $C_{16}$, preferably in the range of from $C_8$ to $C_{12}$, particularly in the range of from $C_9$ to $C_{11}$. The propoxylated surfactant may comprise a blend of surfactants in which about 20% (more particularly 18%) of the $R^3$ group is composed of $C_9$ alkyl groups, about 50% of the $R^3$ group is composed of $C_{10}$ alkyl groups, and about 30% (more particularly 32%) of the $R^3$ group is composed of $C_{11}$ alkyl groups;
- PO represents $C_3H_6O$, and EO represents $C_2H_4O$;
- $m_1$ is preferably in the range of from 0.5 to 6; more preferably 1 to 4; particularly in the range of from 2 to 3; especially in the range of from 2.2 to 2.6; for example 2.4;
- $p_1$ is preferably in the range of from 0 to 9; more preferably in the range of from 2 to 7; particularly in the range of from 3.5 to 5.5; especially in the range of from 5.0 to 5.2; for example 5.1;
- $(m_1+p_1)$ is preferably in the range of from 2 to 12; more preferably in the range of from 5 to 10; particularly in the range of from 6 to 9; especially in the range of from 7 to 8; for example 7.5; and
- Y is —O—, —COO—, —CONH— or —NHCO—, preferably —O—.

$n_1$, $n_2$, $m_1$ and $p_1$ are average values (i.e. can be non-integer).

The (PO) groups and (EO) groups may be present in random or block form, and the order in which (PO) and (EO) groups are added is not limited. Preferably the (EO) group is attached to the hydrophobe, i.e. attached to $R^3$—Y— group and the (PO) group is an endcap.

Preferably $(p_1-m_1)$ is in the range of from 0.5 to 6; more preferably in the range of from 1 to 4; particularly in the range of from 2 to 3; especially in the range of from 2.5 to 2.9, for example 2.7.

The ratio by weight of the first alcohol ethoxylate having the formula $R^1(OCH_2CH_2)_{n1}$—OH to the second alcohol ethoxylate having the formula $R^2(OCH_2CH_2)_{n2}$—OH in the surfactant composition is preferably 1:0.5 to 20; more preferably 1:3 to 15; and particularly 1:5 to 11.

In one embodiment, $R^1$ and $R^2$ are, independently, linear alkyl groups having an average carbon chain length in the range of from $C_5$ to $C_{12}$; particularly in the range of from $C_6$ to $C_{10}$, and especially in the range of from $C_7$ to $C_9$; for example $C_8$. In this embodiment $R^1$ and $R^2$ are preferably the same. The ratio by weight of the first alcohol ethoxylate having the formula $R^1(OCH_2CH_2)_{n1}$—OH to the second alcohol ethoxylate having the formula $R^2(OCH_2CH_2)_{n2}$—OH in the surfactant composition of this embodiment is preferably 1:0.5 to 20; more preferably 1:3 to 10; and particularly 1:5.5 to 6.5.

In another embodiment, $R^1$ and $R^2$ are preferably not the same. In this embodiment, (i) one of $R^1$ or $R^2$, preferably $R^2$, is a linear alkyl group having an average carbon chain length in the range of from $C_5$ to $C_{12}$; particularly in the range of from $C_6$ to $C_{10}$, and especially in the range of from $C_7$ to $C_9$; for example $C_9$; and (ii) the other of $R^1$ or $R^2$, preferably $R^1$, is a linear alkyl group having an average carbon chain length in the range of from $C_9$ to $C_{20}$; particularly in the range of from $C_{10}$ to $C_{18}$, and especially in the range of from $C_{12}$ to $C_{15}$; for example $C_{13}$ to $C_{14}$. In this embodiment, the difference in the average carbon chain length of $R^1$ and $R^2$ ($R^1>R^2$) is preferably in the range of from 3 to 9, particularly in the range of from 4 to 8, and especially in the range of from 5 to 6 carbon atoms. The ratio by weight of the first alcohol ethoxylate having the formula $R^1(OCH_2CH_2)_{n1}$—OH to the second alcohol ethoxylate having the formula $R^2(OCH_2CH_2)_{n2}$—OH in the surfactant composition of this embodiment is preferably 1:3 to 25; more preferably 1:7 to 15; and particularly 1:9.5 to 10.5.

The surfactant composition according to the present invention may further include a second propoxylated surfactant, preferably an alcohol propoxylate. The second propoxylated surfactant preferably also contains ethylene oxide (EO) groups in addition to propylene oxide (PO) groups, i.e. is a propoxylated/ethoxylated surfactant. The second propoxylated surfactant preferably comprises a greater number of (PO) groups than (EO) groups.

The second propoxylated surfactant may be represented by the following formula:

$$R^4—Y-[(PO)_{m2}/(EO)_{p2}]-H$$

in which $R^4$ is a hydrocarbon group, for example a linear alkyl group, having an average chain length in the range of from $C_6$ to $C_{16}$, preferably in the range of from $C_8$ to $C_{12}$, particularly in the range of from $C_9$ to $C_{11}$. The propoxylated surfactant may comprise a blend of surfactants in which about 20% (more particularly 18%) of the $R^4$ group is composed of $C_9$ alkyl groups, about 50% of the $R^4$ group is composed of $C_{10}$ alkyl groups, and about 30% (more particularly 32%) of the $R^3$ group is composed of $C_{11}$ alkyl groups;

PO represents $C_3H_6O$, and EO represents $C_2H_4O$;

$p_2$ is preferably in the range of from 0 to 3.5; more preferably in the range of from 0.5 to 2; particularly in the range of from 0.7 to 1.7; especially in the range of from 1.0 to 1.4; for example 1.2;

$m_2$ is preferably in the range of from 2 to 10; more preferably 3.5 to 8; particularly in the range of from 4.5 to 7; especially in the range of from 5.6 to 6.0; for example 5.8;

$(m_2+p_2)$ is preferably in the range of from 2 to 12; more preferably in the range of from 5 to 10; particularly in the range of from 6 to 8; especially in the range of from 6.5 to 7.5; for example 7; and Y is —O—, —COO—, —CONH— or —NHCO—, preferably —O—.

$m_2$ and $p_2$ are average values (i.e. can be non-integer).

$(m_2-p_2)$ is preferably in the range of from 1 to 8; more preferably in the range of from 2 to 7; particularly in the range of from 4 to 5; especially in the range of from 4.2 to 4.8, for example 4.6.

The (PO) groups and (EO) groups may be present in random or block form, and the order in which (PO) and (EO) groups are added is not limited. Preferably the (EO) group is attached to the hydrophobe, i.e. attached to $R^4$—Y— group and the (PO) group is an endcap.

The surfactant composition suitably comprises the second propoxylated surfactant in a concentration of from 0% to 5% by weight; preferably in a concentration of from 0.1% to 5% by weight, more preferably in a concentration of from 0.5% to 4% by weight; particularly in a concentration of from 0.75% to 2.5% by weight, especially 2% by weight, based on the total weight of surfactants.

The surfactant composition may optionally comprise an additional wetting agent. The inclusion of a wetting agent may further improve the cleaning properties, for example the grease removal capability of the surfactant composition of the invention. For example the surfactant composition may further include a sorbitan ester as a wetting agent. The sorbitan ester may be formed from the reaction of sorbitol with fatty acids or derivatives thereof, e.g. fatty acid methyl, ethyl and/or isopropyl esters or fatty acid triglycerides. Preferred fatty acids comprise in the range from 8 to 24, more preferably 10 to 22, particularly 12 to 20, and especially 12 to 18 carbon atoms. The sorbitan esters may comprise a mixture of mono-, di-, tri- and optionally tetra-esters. Linear fatty acids are preferred. Suitable fatty acids include capric, lauric, myristic, palmitic, stearic, and/or behenic. Suitable sorbitan esters include but are not limited to sorbitan cocoate, sorbitan caprate, sorbitan laurate, sorbitan myristate, sorbitan palmitate and/or sorbitan stearate. Preferably, the wetting agent is sorbitan laurate.

The wetting agent can be present in the surfactant composition in a concentration of from 0% to 5% by weight. In one embodiment, the wetting agent is present in a concentration of from 0.5% to 3% by weight; preferably in a concentration of from 0.75% to 2% by weight, particularly 1% by weight based on the total weight of surfactants.

In one embodiment, the surfactant composition according to the present invention preferably comprises, consists essentially of, or consists of (i) the mixture of the alcohol ethoxylate surfactants in a concentration of from 90% to 99.9% by weight; more preferably in a concentration of from 92% to 98% by weight; particularly in a concentration from 94% to 97%; for example 96% by weight, based on the total weight of surfactants, (ii) a first propoxylated surfactant in a concentration of from 0.1% to 5% by weight; more preferably in a concentration of from 0.5% to 4% by weight; particularly in a concentration of from 1% to 3% by weight; especially in a concentration of 2% by weight, based on the total weight of surfactants, (iii) a second propoxylated surfactant in a concentration of from 0% to 2.5% by weight; more preferably in a concentration of from 0.5% to 2% by weight; particularly in a concentration of from 0.75% to 1.5% by weight, especially 1% by weight, based on the total weight of surfactants, and (iv) a wetting agent, preferably a sorbitan ester, in a concentration of from 0% to 5% by weight; more preferably in a concentration of from 0.5% to 3% by weight; particularly in a concentration of from 0.75% to 2% by weight, especially 1% by weight based on the total weight of surfactants.

In another embodiment, the surfactant composition according to the present invention preferably comprises, consists essentially of, or consists of (i) the mixture of the alcohol ethoxylate surfactants in a concentration of from 90% to 99.9% by weight; more preferably in a concentration of from 92% to 98% by weight; particularly in a concentration from 94% to 97%; for example 94% by weight, based on the total weight of surfactants, (ii) a first propoxylated surfactant in a concentration of from 0.1% to 8% by weight; more preferably in a concentration of from 1% to 6% by weight; particularly in a concentration of from 2% to 6% by weight; especially in a concentration of 4% by weight, based on the total weight of surfactants, and (iii) a second propoxylated surfactant in a concentration of from 0% to 5% by weight; more preferably in a concentration of from 0.5% to 4% by weight; particularly in a concentration of from 0.75% to 2% by weight, especially 2% by weight, based on the total weight of surfactants.

The surfactant composition of the present invention may be used to clean animal fibers. The surfactant composition of the present invention is preferably used to clean animal fibers containing an oily or grease-containing residue. Preferably, the surfactant composition of the present invention is used to remove grease from wool.

In a further aspect, the present invention provides cleaned animal fibers, for example scoured wool, obtainable by the method of cleaning animal fibers discussed herein. It has been advantageously found that the method of cleaning animal fibers using the surfactant composition of the present invention provides for excellent grease removal properties from animal fibers, such as for example wool. The method of the invention preferably provides at least 90%, more preferably at least 95%, more preferably at least 96%, in particular at least 97%, especially at least 98%, for example at least 99% grease removal from animal fibers, such as for example from wool.

In a still further aspect, the present invention provides a grease residue obtainable by the method of cleaning animal fibers as discussed herein. Animal grease, for example wool grease comprises a complex mixture of wax esters of long chain fatty acids and alcohols. Examples of long chain fatty alcohols present in animal grease (for example wool grease) include cholesterol, lanosterol and dihydrolanosterol. The long chain fatty acids and alcohols present in the animal grease (for example wool grease) comprise a wide distribution of components have a wide range of chain lengths.

When surfactants are used to remove grease from animal fibers, such as for example wool grease, a stable grease micelle is formed in which the hydrocarbon moiety of the surfactant is embedded in the emulsified grease while the hydrophilic chain mingles with the surrounding water.

The surfactant composition of the present invention provides a blend of alcohol ethoxylated and propoxylated surfactant(s) having a wide distribution of the ratio of the length of the hydrophobe (i.e. the hydrocarbon moiety) to the number of ethoxylate/propoxylate groups (i.e. the hydrophilic moiety) in the surfactant molecules. It has advantageously been found that the surfactant composition of the present invention is able to be used to clean, for example scour, all types and qualities of animal fibers, such as for example wool, unlike conventional surfactants. For example, the composition of the present invention has been surprisingly found to provide a greater ability to remove grease (and a wider range of grease) from animal fibers such as for example wool when compared to conventional surfactants. It is believed that this improved grease removal and for example the improved range of grease removal from the fibers may be due to the surfactant composition of the present invention providing a wide distribution of surfactant molecules having a wide range of ratios for the hydrophobe chain length compared to the number of hydrophilic moieties.

The surfactant composition of the present invention has advantageously been found to have improved efficiency for the removal of a greater range of grease substances, for example for the removal of grease substances having a wide distribution of chain lengths, from the animal fibers such as for example wool.

The method and surfactant composition of the present invention have advantageously been found to produce higher quality cleaned animal fibers, such as for example scoured wool, compared to the cleaned animal fibers provided by the use of conventional surfactants, such as nonyl phenol ethoxylate based surfactants. It has also advantageously been found that the surfactant composition of the present invention provides cleaned animal fibers, such as for example scoured wool, which looks cleaner than the resultant cleaned animal fibers provided by conventional surfactant compositions. This is indicative of the surfactant composition of the present invention having a greater ability to remove dirt, such as for example grease, from the animal fibers, such as for example wool. For example, this is indicative of the surfactant composition of the present invention having a greater ability to remove a greater quantity and/or a greater range of grease components from the animal fibers, such as for example wool compared to conventional surfactants. In particular, the present invention has been found to produce cleaned animal fibers such as for example scoured wool with improved brightness, improved scouring, a lower ash content; and/or lower residual grease.

The method described herein has therefore advantageously been found to provide cleaned animal fibers, for example scoured wool having a lower ash content. A lower ash content is consistent with the surfactant composition of the present invention having improved soil, dirt and/or grease removal capability from the animal fibers such as wool. A lower ash content also indicates that the use of the surfactant composition of the present invention provides limited or substantially no greying of the animal fibers, for example wool and also provides extremely low or substantially no detergent residues on the resultant cleaned/scoured animal fibers. It has also been surprisingly found that the surfactant composition of the present invention can be used to produce cleaned/scoured animal fibers such as wool having lower odour or substantially no odour at all. As such, it has been surprisingly found that the method and surfactant composition of the present invention produce cleaned/scoured animal fibers, for example wool, which is cleaner than the scoured wool produced by conventional detergents.

It has been surprisingly found that the method of the present invention can be used to provide an increase in grease removal from animal fibers, for example wool grease removal, of at least about 5%, preferably from 5% to 10%, more preferably from 6 to 8% when compared to the use of conventional surfactants.

The present invention also preferably provides a surfactant composition which in use provides reduced foaming when compared to the foaming produced by the use of conventional surfactant compositions. Furthermore, use of the surfactant composition of the present invention preferably provides a foam which is significantly less stable, for example collapses quickly over time when compared to the foam produced by the use of conventional surfactant compositions. The reduced foaming produced by the use of the surfactant composition of the present invention advantageously makes the surfactant composition easier to handle and use in the method of cleaning animal fibers, such as wool. The surfactant composition of the present invention may also be present in a greater concentration or dosage during the method of cleaning animal fibers. The increased concentration or dosage of the surfactant composition of the present invention in the method of cleaning the animal fibers may therefore provide an increased level of cleaning of the animal fibers, for example an increased level of grease removal.

The HLB (hydrophile-lipophile balance) value of the surfactant composition is determined by the size of the hydrophilic portion of a molecule of the surfactant composition compared to the size of the lipophilic portion (the hydrophobe portion). The higher the HLB value, the more water soluble the surfactant. The surfactant composition of the present invention preferably has an HLB value in the range of from 12.9 to 15, more preferably in the range of from 13.2 to 14.5, particularly 13.4 to 13.8, especially 13.6.

The quality of the grease, for example wool grease, removed from the animal fibers may be determined by acid cracking. The acid cracking method may be used to determine a number of factors:

- Acid value: the measure of the amount of fatty acids present in the sample. The lower the value, the better the quality of the grease obtained.
- SAP value (Saponification value): this is a measure of the amount of base required to completely saponify the grease. This determines the amount of degradation of the grease. The lower the SAP value the more degraded the wool grease.
- SAP value–Acid value: This parameter is used to negate the effect on the SAP value by high fatty acid contents or residual organic acid contents. A low SAP value–Acid value would imply a shorter average chain ester and therefore indicate the recovery of more harder to separate shorter chain esters from the fibers.
- Sterols: A high cholesterol % is valuable if the woolgrease is to be used for cholesterol recovery or lanolin alcohol manufacture. A low isocholesterol recovery allows a high efficiency in cholesterol recovery. The ratio of cholesterol:isocholesterol can be used. The higher the figure, the higher the potential cholesterol efficiency.
- Drop point: indicates whether more short chain esters have been recovered. This figure can be highly effected by acidic soaps and other factors.

In a further aspect, the present invention preferably provides a grease residue obtained by the method of cleaning animal fibers, for example wool using a surfactant composition as discussed herein, in which the grease residue comprises an increased level of short chain grease esters compared to the grease residue obtained using conventional surfactant compositions such as for example nonylphenol ethoxylate detergents.

The presence of short chain grease esters in the resultant grease residue may be determined by measuring the acid value and the SAP value as discussed earlier. The higher the SAP value-Acid value the greater the implication that the residue comprises shorter average chain esters i.e. the grease residue recovered includes a greater proportion of short chain esters. Short chain esters are significantly harder to separate and recover from animal fibers such as for example wool. Preferably, the SAP value−Acid value for the grease residue obtained by the method of the invention is at least 97; more preferably at least 98; particularly at least 98.5; for example 98.57.

In particular, the present invention preferably provides a grease residue obtainable by the method of cleaning animal fibers, for example wool, using a surfactant composition as discussed herein, in which the grease residue comprises an increased ratio of cholesterol to isocholesterol recovery from the fibers compared to the grease residue obtained using conventional surfactant compositions such as for example nonylphenol ethoxylate.

Preferably the grease residue obtained by the method and surfactant composition of the invention comprises a mixture of cholesterol and isocholesterol in which the ratio of cholesterol:isocholesterol is at least 1.9; more preferably at least 2.0; particularly at least 2.02; more especially at least 2.09.

The surfactant compositions of embodiments of the present invention preferably provide grease residues extracted from animal fibers, for example wool grease, having a lower level of degradation than the wool greases obtained by extraction with conventional surfactant compositions such as for example nonylphenol ethoxylate. The level of degradation can be determined from the acid value of the grease residue. The grease residue obtained by the method of the present invention as discussed herein preferably has an acid value of preferably less than 10 mg KOH/g; more preferably less than 5 mg KOH/g; particularly less than 3 mg KOH/g; more particularly less than 2.5 mg KOH/g; especially less than 2.2 mg KOH/g.

It has been found that the process of removing grease from animal fibers using conventional surfactants results in the formulation of extremely stable dispersions of wool grease which defies most conventional methods of demulsification and phase separation. This therefore makes the recovery of grease, such as for wool grease, from the emulsions very problematic. The measure of the stability of the grease obtained from animal fibers, for example the woolgrease mixture, obtained by the method of the invention as discussed herein gives a measure of the amount of grease (for example woolgrease) which will be able to be removed by centrifugal separation in the separators of commercial woolscours. It has been surprisingly found that the grease emulsions obtained using the method of the present invention as discussed herein have reduced stability which advantageously leads to improved and easier recovery of the grease (for example wool grease). The stability of the emulsion can be determined from the speed of splitting of the emulsions using a centrifuge. The emulsions provided by the method of the present invention as discussed herein have surprisingly been found to have much lower splitting speeds than the grease obtained from animal fibers using conventional surfactants. The speed of development of the woolgrease peak at the top of is measured and graphed against time. The speed of splitting of the emulsion is measured by comparing the time taken for 60% and 80% of the final peak area to be produced. The speed of splitting of the emulsion to produce 60% of the final peak area is preferably less than 15 min, more preferably less than 10 min, in particular less than 7 min, for example about 5 min. The speed of splitting of the emulsion to produce 80% of the final peak area is preferably less than 50 min, more preferably less than 40 min, in particular less than 30 min, for example about 25 min.

As used herein, the term "about" modifying the quantity of an ingredient in the compositions of the invention or employed in the methods of the invention refers to variation in the numerical quantity that occur, for example, through typical measuring and liquid handling procedures used for making the composition; through inadvertent error in these procedures; through difference in the manufacture, source or purity of the ingredients employed to makes the compositions or carry out the methods; and the like.

The surfactant composition of the invention may be provided as a solid, liquid or gel. For example the composition may be provided as a capsule or pellet of powder, a solid or loose powder. The capsule or pellet may be introduced into a volume of water to degrade allowing contact of the composition of the invention with the water.

The composition of the invention may be provided as a liquid, for example a liquid concentrate. The liquid concentrate composition may be diluted through dispensing equipment using aspirators, peristaltic pumps, mass flow meters etc. The liquid concentrate composition may be delivered in bottles, jars, dosing bottles etc. The liquid concentrate composition may be present within a cartridge insert for insertion into a spray bottle with a pre-determined amount of water.

Known degreasing compositions for animal fibers may employ solvents which are potentially harmful to the environment. The solvents may act as carriers for the surfactants contained within. The surfactant composition of the present invention has enhancing cleaning capabilities (for example degreasing capabilities) while remaining substantially free of solvent. As such, the surfactant composition has an improved environmentally friendly profile. However, the composition of the invention may include a solvent in order to adjust the viscosity of the final composition. The presence or absence of a solvent in the composition of the invention may be determined by the final use of the composition. A solvent is however not required within the composition of the invention in order to boost the cleaning efficiency of the composition. The composition of the invention may be provided as a concentrate and may be substantially solvent-free. In an alternate embodiment, the composition of the invention may be provided as a ready-to-use (RTU) composition. If the composition of the invention is provided as a RTU composition, water may be added to the composition as a diluent.

The invention has been illustrated by the following non-limiting examples.

EXAMPLES

Example 1

Wool Scouring

Two hot bowls (bowls 1 and 2), 800 ml beaker in size, were prepared by adding 0.75% wt/wt of the surfactant composition into 500 ml of deionised water and heating to 70° C. These two detergent containing bowls were kept at 70° C. inside a tergotemeter. Two cold rinse bowls (bowls 3 and 4), 800 ml beakers, were prepared by using 500 ml of deionised water. These bowls were allowed to equilibriate to room temperature, normally 20-25° C.

50 g (+/−1 g) of greasy unscoured wool was accurately weighed to 2 decimal places. This wool was then added into the first hot bowl. The wool was agitated at 50 rpm for 2 minutes before being removed from the bowl, drained and then any residual water, detergent squeezed into the first bowl. This process was repeated for the second hot bowl.

The hot scoured wool was then placed in the first cold rinse bowl and slowly agitated for 2 minutes before being removed, drained and squeezed into the first cold rinse bowl This process was repeated with the second cold rinse bowl.

This process produces four bowls containing grease residues: two hot scouring bowls and two cold rinse bowls. The spent solution in each of these bowls were then extracted separately in a 1 L separating funnel using 2×200 ml of heptanes (at 60° C.). The combined 400 ml of heptanes was then transferred into a preweighed 1 L evaporating flask. Evaporation was carried out in an oven at 80° C. for 60 minutes to obtain the woolgrease residue. This process was repeated for each of the bowls. The amounts present in the two rinse bowls were combined.

The scoured wool was then submerged in 400 ml heptanes at 60° C. and agitated for 1 minute to remove any remaining residual woolgrease. The heptanes was then evaporated in an oven at 80° C. for 60 minutes to obtain the woolgrease residue remaining on the wool after the processing.

The weights of the woolgrease obtained in the two hot bowls, the two cold bowls and the woolgrease residue on the wool after scouring was then used to calculate the woolgrease removed at each stage. The results are shown for three different surfactants in FIG. 1.

Surfactant composition 1 comprises alcohol ethoxylates having the formulae: $R^1(OCH_2CH_2)_{n1}$—OH and $R^2(OCH_2CH_2)_{n2}$—OH in which $R^1$ is 8; $n^1$ is 2; $R^2$ is 8 and $n^2$ is 6.5. The ratio of $R^1(OCH_2CH_2)_{n1}$—OH to $R^2(OCH_2CH_2)_{n2}$—OH is 1:6.

Surfactant composition 2 comprises:

96 wt. % of alcohol ethoxylates having the formulae: $R^1(OCH_2CH_2)_{n1}$—OH and $R^2(OCH_2CH_2)_{n2}$—OH in which $R^1$ is 8; $n^1$ is 2; $R^2$ is 8 and $n^2$ is 6.5. The ratio of $R^1(OCH_2CH_2)_{n1}$—OH to $R^2(OCH_2CH_2)_{n2}$—OH is 1:6;

2 wt. % of a first propoxylated surfactant comprising: $R^3$—Y-[$(PO)_{2.4}/(EO)_{5.1}$]-H in which $R^3$ is an alkyl group having an average carbon chain length in the range of from $C_9$ to $C_{11}$, and Y is —O—, —COO—, —CONH— or —NHCO—;

1 wt. % of a second propoxylated surfactant comprising: $R^4$—Y-[$(PO)_{5.8}/(EO)_{1.2}$]-H in which $R^4$ is an alkyl groups having an average carbon chain length in the range of from $C_9$ to $C_{11}$; $n^5$ is 5.8, $n^6$ is 1.2, and Y is —O—, —COO—, —CONH— or —NHCO—; and 1 wt. % sorbitan laurate.

Surfactant 3 is conventional surfactant nonyl phenol ethoxylate.

As shown in FIG. 1, surfactants 1 and 2 have significantly improved grease removal from the wool compared to nonyl phenol ethoxylate (surfactant 3). This can be seen from the section of the chart relating to the amount of grease remaining on the fleece. Surfactants 1 and 2 produced cleaned wool having the lowest amount of grease remaining on the cleaned wool. Furthermore, it can be seen that surfactant 2 has the greatest grease removal properties as it was found that substantially no grease remains on the cleaned wool fleece.

Example 2

Comparison of Quality of Wool Produced by Wool Scouring

A first sample of wool was degreased using conventional surfactant nonylphenol ethoxylate (TERIC N9) using the method of Example 1. A second sample of wool was degreased using surfactant composition 2. The first and second samples of wool came from the same wool batch for processing.

The following wool parameters were investigated:

AS IS Y: relates to the brightness of the scoured wool. The higher the AS IS Y value the brighter the resultant scoured wool;

ΔY: The difference between the Y tristimulus values determined from base and "as is" colour on the same global sample of commercially scoured wool. The lower the ΔY number the greater the scouring capability of the surfactant composition;

Ash content: The lower the number the less greying of the fibers which is indicative of less detergent residues left on the fibers; and Residual grease: This is determined from the smell and feel of the fiber.

The wool samples were then tested by near infrared analysis (NIR). A sample of the first and second wool samples was also sent to an external testing house. The results are illustrated in the Table 1.

TABLE 1

| | | TETRIC N9 | | Surfactant composition 2 | |
|---|---|---|---|---|---|
| | | In house (NIR) | Test house | In house (NIR) | Test house |
| BASE COLOUR | D65/10 | 68.8 | 70.2 | 69.4 | 70.6 |
| | C/2(W) | | 66.2 | | 66.6 |
| AS IS COLOUR | D65/10 | 65.8 | 68.0 | 66.6 | 70.9 |
| | C/2(W) | | 64.1 | | 66.9 |
| | ΔY | 3.0 | 2.1 | 2.8 | −0.3 |
| | Ash content | | 1.1% | | 0.8% |
| | Residual grease | 0.15% | 0.20% | 0.13% | 0.13% |

As can be seen from the results in Table 1, the external test house found that in all of the assessed wool quality parameters the wool scoured with surfactant composition 2 was of a higher quality than for the wool scoured using the conventional surfactant nonyl phenol ethoxylate detergent.

The AS IS Y values show that the wool scoured using surfactant composition 2 has a higher AS IS Y score (70.9 and 66.9) when compared to the score for the wool scoured using conventional surfactant nonyl phenol ethoxylate detergent (68.0 and 64.1). The present invention therefore advantageously provides a method and a surfactant composition for producing brighter and therefore cleaner scoured wool.

The results in Table 1 also show that the ΔY value for the scoured wool obtained using surfactant composition 2 is lower (and even negative) than the results provided for the scoured wool obtained using the conventional surfactant nonyl phenol ethoxylate detergent. This shows that surfactant composition 2 (and the surfactant compositions of the present invention) has improved scouring capability and can scour the wool to the maximum possible quality when compared to conventional surfactants.

Surfactant composition 2 is also shown in Table 1 to produce wool with a lower ash content (0.8%) than the wool scoured using conventional surfactant nonyl phenol ethoxylate detergent (1.1%). Advantageously, surfactant composition 2 has been found to produce scoured wool without any greying of the wool and without any detergent residue.

Surfactant composition 2 has been shown in Table 1 to provide scoured wool with a much lower residual grease content (0.13%) when compared to the scoured wool produced by the nonyl phenol ethoxylate detergent (0.15%; 0.20%). This is also evidence from the smell and feel of the fiber. Surfactant composition 2 was found to advantageously produce scoured wool with noticeably no smell.

Example 3

Grease Recovery

Four batches of wool were split to either be treated with the conventional surfactant nonyl phenol ethoxylate (TERIC N9) or surfactant composition 2 using the method of Example 1. The results for the grease recovery rates are shown in Table 2.

TABLE 2

| Batch No. | Nonylphenol ethoxylate (TERIC N9) | Surfactant Composition 2 | Difference (%) | % Increase |
|---|---|---|---|---|
| 1 | 1.98% | 2.09% | 0.11 | +5.6% |
| 2 | 1.72% | 1.83% | 0.11 | +6.4% |
| 3 | 2.90% | 3.07% | 0.17 | +5.9% |
| 4 | 3.53 | 3.62% | 0.09 | +2.5% |

It can be concluded from the results shown in Table 2 that the use of surfactant composition 2 (and the surfactant compositions of the present invention) provides an increase in grease recovery from wool of about 5 to 6% when compared to the grease recovered from wool using conventional surfactant nonylphenol ethoxylate. Optimisation of correct dosage of the surfactant composition of the present invention and/or increasing the wool scouring feed rate in the process may increase the grease recovery further, and it is likely that the grease recovery by surfactant composition 2 (and the surfactant compositions of the present invention) could be increased to be about 10% more than the grease recovered using conventional surfactants such as nonylphenol ethoxylate.

Example 4

Woolgrease Quality

The quality of the wool grease recovered by the surfactants is determined by acid treatment. The following values are determined:

- Acid value: the measure of the amount of fatty acids present in the sample. The lower the value, the better the quality of the grease;
- SAP value (Saponification value): this is a measure of the amount of base required to completely saponify the grease. This determines the amount of degradation of the grease. The lower the SAP value the more degraded the wool grease;
- SAP value−Acid value: This parameter is used to negate the effect on the SAP value by high fatty acid contents or residual organic acid contents. A low SAP value−Acid value would imply a shorter average chain ester and therefore indicate the recovery of more harder to separate shorter chain esters;
- Sterols: A high cholesterol % is valuable if the woolgrease is to be used for cholesterol recovery or lanolin alcohol manufacture. A low isocholesterol recovery allows a high efficiency in cholesterol recovery. The ratio of cholesterol:isocholesterol can be used. The higher the figure, the higher the potential cholesterol efficiency; and
- Drop point: indicates whether more short chain esters have been recovered. This figure can be highly effected by acidic soaps and other factors.

The results for the use of surfactant composition 2 and for cleaning using conventional surfactant nonylphenol ethoxylate for scoured wool are illustrated in Table 3:

TABLE 3

| Sample No. | Detergent | Acid value (mg KOH/g) | SAP value (mg KOH/g) | SAP value-Acid value (mg KOH/g) |
|---|---|---|---|---|
| 1 | Surfactant Composition 2 | 9.74 | 108.31 | 98.57 |
| 2 | Nonylphenol ethoxylate (TERIC N9) | 10.13 | 106.85 | 96.72 |
| 3 | Surfactant Composition 2 | 15.11 | 113.68 | 98.57 |
| 4 | Nonylphenol ethoxylate (TERIC N9) | 8.64 | 101.68 | 93.04 |
| 5 | Surfactant Composition 2 | 2.12 | 95.66 | 93.54 |
| 6 | Nonylphenol ethoxylate (TERIC N9) | 3.87 | 98.48 | 94.61 |
| 7 | Surfactant Composition 2 | 2.24 | 102.24 | 100.00 |
| 8 | Nonylphenol ethoxylate (TERIC N9) | 6.99 | 103.34 | 96.35 |

The results shown in Table 3 illustrate that for three of the four paired results the use of surfactant composition 2 provides wool grease having an increased SAP value-acid value when compared to grease obtained using conventional surfactant nonylphenol ethoxylate detergent. This illustrates that surfactant composition 2, and the surfactant composition of the invention, may be used to recover a greater proportion of short chain wool grease esters than conventional surfactants. It is believed that this is due to the surfactant composition comprising a blend of surfactants having a wide distribution of hydrophobe length to number of ethoxylate/propoxylate groups. Short chain wool grease residues are much more difficult to separate from the animal fibers.

The acid values of the woolgreases obtained for surfactant composition 2 were lower in three out of the four paired examples when compared to the acid values of the woolgreases obtained by conventional surfactant nonylphenol ethoxylate. The fourth sample retained some residual organic acid and when comparing the SAP acid value figures for this batch the surfactant composition of the invention was found to have lower degradation. It is therefore believed that the fatty acid content of this sample is lower than the sample produced by nonylphenol ethoxylate extraction. The lower acid values of the woolgreases obtained by surfactant composition 2 are indicative of a lower level of degradation of the wool grease. Surfactant composition 2 of the present invention may therefore be used to provide wool grease having a lower level of degradation than the wool greases obtained by extraction with conventional surfactant compositions such as nonylphenol ethoxylate.

Example 5

Wool Grease Quality—Sterol Content

The following table illustrates the results for the sterols present in the woolgreases obtained by either nonylphenol ethoxylate extraction (conventional surfactant) or by extraction using surfactant composition 2.

TABLE 4

| Sample No. | Detergent | Cholesterol | Isocholesterol | Cholesterol/ Isocholesterol |
|---|---|---|---|---|
| 1 | Surfactant Composition 2 | 11.3 | 5.4 | 2.09 |
| 2 | Nonylphenol ethoxylate (TERIC N9) | 11.5 | 5.8 | 1.98 |
| 3 | Surfactant Composition 2 | 9.7 | 4.8 | 2.02 |
| 4 | Nonylphenol ethoxylate (TERIC N9) | 12.9 | 6.5 | 1.98 |
| 5 | Surfactant Composition 2 | 13.6 | 7.1 | 1.92 |
| 6 | Nonylphenol ethoxylate (TERIC N9) | 12.9 | 7.3 | 1.77 |

Use of surfactant composition 2 appears to provide woolgrease having a higher ratio of cholesterol to isocholesterol when compared to the woolgrease extracted using conventional surfactant. The surfactant compositions of the present invention may therefore be used to provide greater selectivity for the removal of cholesterol from animal fibers such as wool.

Example 6

Speed of Splitting of Woolgrease

The measure of the stability of the woolgrease mixture obtained using the method of Example 1 gives a measure of the amount of woolgrease that can be removed by centrifugal separation in the separators of commercial woolscourers.

The first wool scouring bowl liquours of Example 1 are agitated using a Janke and Kunkel Ultra-Turrax T25 at 8000 rpm for exactly 5 seconds. 20 ml of the solution is then immediately transferred via a 20 ml syringe to a Turbiscan vial and the lid secured tightly. This solution is then immediately analysed on a Turbiscan lab analyser set at 60° C. to measure 1 scan per minute for 120 minutes.

The speed of development of the woolgrease peak at the top of the vial is measured and graphed against time. The speed of splitting of the emulsion is measured by comparing the time taken for 60% and 80% of the final peak area to be produced. The results are shown in Table 5.

TABLE 5

| Surfactant | Time for 60% of final peak area (min) | Time for 80% of final peak area (min) |
|---|---|---|
| Surfactant Composition 1 | 7.32 | 30.78 |

Example 7

Foaming Produced by the Surfactants

Figure 2:
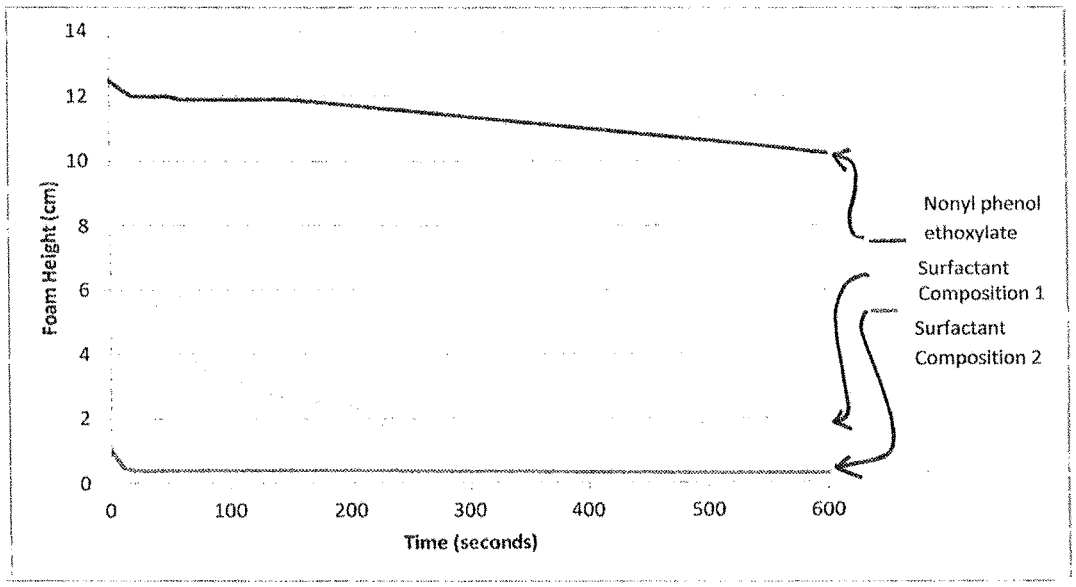
FIG. 2 shows the results for the Ross-Miles foam test for three surfactants.

The foam produced by the surfactant may be measured using the Ross-Miles foam test. The Ross-Miles foam test generates foam under low-agitation conditions. The test results provide information on the initial foam height and on the foam decay over time. The results are shown in FIG. 2 for three surfactants: a) surfactant composition 2 b) 100% of a blend of alcohol ethoxylates having the formulae: $R^1(OCH_2CH_2)_{n1}$—OH and $R^2(OCH_2CH_2)_{n2}$—OH according to the invention; and c) nonyl phenol ethoxylate.

It can be seen from FIG. 2, that the foams produced by the use of surfactants a) and b) (the surfactants of the present invention) have a significantly reduced foam height compared to the foam produced by the conventional surfactant (surfactant c)). The foam produced by surfactant composition 2 has the lowest initial foam height (approx. 1 cm) of the three examples. Surfactant b) produces an initial foam height of approx. 8 cm. In contrast the conventional surfactant nonyl phenol ethoxylate (TERIC 9) produces an initial foam height of over 12 cm.

Furthermore, it can be seen that the foams produced by the blend of alcohol ethoxylates (surfactant b)) and by surfactant composition 2 (surfactant a)) are significantly less stable than the foam produced by the conventional surfactant (surfactant c)). The foams produced by the surfactants of the invention (surfactant composition 2) appear to break down and collapse quickly over time. The foam height of the foam produced by surfactant a) reduces to less than half of the initial foam height within less than 1 minute. The foam height of the foam produced by surfactant b) reduces to less than half of the initial foam height within 90 seconds. In contrast, the foam height of the foam produced by surfactant c) (the conventional surfactant) reduces by approx 20% of the initial foam height in approx. 10 minutes. FIG. 2 shows that the foam heights produced by the surfactants of the present invention reduce by approximately half in a significantly shorter period of time compared to the foams produced by conventional surfactants.

Example 8

Surfactant composition 4 comprises:

94 wt. % of alcohol ethoxylates having the formulae: $R^1(OCH_2CH_2)_{n1}$—OH and $R^2(OCH_2CH_2)_{n2}$—OH in which $R^1$ is 12-15; $n^1$ is 2; $R^2$ is 8 and $n^2$ is 6.5. The ratio of $R^1(OCH_2CH_2)_{n1}$—OH to $R^2(OCH_2CH_2)_{n2}$—OH is 1:10;

4 wt. % of a first propoxylated surfactant comprising: $R^3$—Y-[$(PO)_{2.4}$/$(EO)_{5.1}$]-H in which $R^3$ is an alkyl group having an average carbon chain length in the range of from $C_9$ to $C_{11}$, and Y is —O—, —COO—, —CONH— or —NHCO—; and 2 wt. % of a second propoxylated surfactant comprising: $R^4$—Y-[$(PO)_{5.8}$/$(EO)_{1.2}$]-H in which $R^4$ is an alkyl groups having an average carbon chain length in the range of from $C_9$ to $C_{11}$; $n^5$ is 5.8, $n^6$ is 1.2, and Y is —O—, —COO—, —CONH— or —NHCO—.

Surfactant composition 4 was subjected to the test procedures described above and gave results equivalent to that of surfactant composition 2.

The invention claimed is:

1. A method of cleaning animal fibers comprising contacting the animal fibers with a surfactant composition comprising a mixture of alcohol ethoxylate surfactants, wherein the composition further comprises at least one propoxylated surfactant represented by the following formula:

$$R^3—Y-[(PO)_{m1}/(EO)_{p1}]-H$$

wherein:

$R^3$ is a hydrocarbon group having an average chain length in the range of from $C_6$ to $C_{16}$;

PO represents $C_3H_6O$, and EO represents $C_2H_4O$;

$m_1$ is in the range of from 0.5 to 6;

$p_1$ is in the range of from 0 to 9;

wherein $(p_1-m_1)$ is in the range of from 0.5 to 6; and

Y is —O—, —COO—, —CONH— or —NHCO—.

2. A method as claimed in claim 1, wherein the animal fibers are wool.

3. A method as claimed in claim 1, wherein the surfactant composition comprises a blend of alcohol ethoxylates represented by the following formulae:

$$R^1(OCH_2CH_2)_{n1}—OH \text{ and } R^2(OCH_2CH_2)_{n2}—OH$$

wherein:

$R^1$ and $R^2$ are, independently, linear alkyl groups having an average carbon chain length in the range of from $C_5$ to $C_{20}$;

$n_1$ is in the range of from 0.5 to 4;

$n_2$ is in the range of from 3.5 to 10; and $(n_2-n_1)$ is in the range of from 2 to 8.

4. A method as claimed in claim 3, wherein $R^1$ and $R^2$ are in the range of from $C_6$ to $C_{10}$.

5. A method as claimed in claim 3, wherein one of $R^1$ and $R^2$ is in the range of from $C_6$ to $C_{10}$ and the other of $R^1$ and $R^2$ is in the range of from $C_{10}$ to $C_{18}$.

6. A method as claimed in claim 3, wherein $n_1$ is in the range of from 1 to 3 and/or $n_2$ is in the range of from 5 to 8.

7. A method as claimed in claim 3, wherein $(n_2-n_1)$ is in the range of from 3 to 6.

8. A method as claimed in claim 1, wherein Y is —O—.

9. A method as claimed in claim 1, wherein the propoxylated surfactant the (EO) group is attached to the $R^3$—Y— group and the (PO) group is an endcap.

10. A method as claimed in claim 1, wherein the surfactant composition has an HLB value in the range of from 12.9 to 15.

11. A method as claimed in claim 10, in which the surfactant composition has an HLB value in the range of from 13.4 to 13.8.

12. A method as claimed in claim 1, wherein the surfactant composition further comprises a second propoxylated surfactant.

13. A method as claimed in claim 12, wherein the second propoxylated surfactant has the following formula:

$$R^4—Y-[(PO)_{m2}/(EO)_{p2}]-H$$

wherein:

$R^4$ is a hydrocarbon group having an average chain length in the range of from $C_6$ to $C_{16}$;

PO represents $C_3H_6O$, and EO represents $C_2H_4O$;

$p_2$ is in the range of from 0.25 to 3.5;

$m_2$ is in the range of from 2 to 10; and

Y is —O—, —COO—, —CONH— or —NHCO—.

14. A method as claimed in claim 13, in which the (EO) group in the second propoxylated surfactant is attached to the $R^4$—Y— group and the (PO) group is an endcap.

15. A method of cleaning animal fibers comprising contacting the animal fibers with a surfactant composition comprising a mixture of alcohol ethoxylate surfactants, wherein the composition further comprises at least one propoxylated surfactant represented by the following formula:

$$R^3—Y-[(PO)_{m1}/(EO)_{p1}]-H$$

wherein:

$R^3$ is a hydrocarbon group having an average chain length in the range of from $C_6$ to $C_{16}$;

PO represents $C_3H_6O$, and EO represents $C_2H_4O$;

$m_1$ is in the range of from 0.5 to 6;

$p_1$ is in the range of from 0 to 9; and

Y is —O—, —COO—, —CONH— or —NHCO—;

wherein the surfactant composition further comprises a second propoxylated surfactant having the following formula:

$$R^4—Y-[(PO)_{m2}/(EO)_{p2}]-H$$

wherein:

$R^4$ is a hydrocarbon group having an average chain length in the range of from $C_6$ to $C_{16}$;

PO represents $C_3H_6O$, and EO represents $C_2H_4O$;

$p_2$ is in the range of from 0.25 to 3.5;

$m_2$ is in the range of from 2 to 10; and

Y is —O—, —COO—, —CONH— or —NHCO—.

16. A method as claimed in claim 15, in which the (EO) group in the second propoxylated surfactant is attached to the $R^4$—Y— group and the (PO) group is an endcap.

* * * * *